United States Patent [19]

Thomas, Jr.

[11] 4,388,862

[45] Jun. 21, 1983

[54] APPARATUS FOR SILK SCREEN PRINTING

[76] Inventor: Thomas A. Thomas, Jr., 4100 SW. 58th Ter., Davie, Fla. 33314

[21] Appl. No.: 332,254

[22] Filed: Dec. 18, 1981

[51] Int. Cl.[3] ..... B41F 15/20

[52] U.S. Cl. ..... 101/126; 101/128.1; 101/129

[58] Field of Search ..... 101/116–124, 101/126, 127, 128.1, 129

[56] References Cited

U.S. PATENT DOCUMENTS

| | | | |
|---|---|---|---|
| 1,922,710 | 8/1933 | Owens | 101/123 |
| 2,397,731 | 4/1946 | Fowler | 101/123 |
| 4,031,825 | 6/1977 | Jaffe | 101/126 |
| 4,305,331 | 12/1981 | Colapinto | 101/126 |
| 4,315,461 | 2/1982 | Harpold | 101/115 |

FOREIGN PATENT DOCUMENTS

| | | | |
|---|---|---|---|
| 1924129 | 12/1972 | Fed. Rep. of Germany | 101/126 |
| 681259 | 10/1952 | United Kingdom | 101/123 |
| 683800 | 12/1952 | United Kingdom | 101/126 |
| 777022 | 6/1957 | United Kingdom | 101/126 |

OTHER PUBLICATIONS

Ranar, 5/17/76 advertisement by Ranar Mgf. Co. for screen printing equipment.

*Primary Examiner*—Clyde I. Coughenour
*Attorney, Agent, or Firm*—Joseph Zallen

[57] ABSTRACT

A screen printing device for T-shirts and the like including a flat perforated portion on which the T-shirt is positioned, a vacuum being applied to cause the ink to go through the printing screen.

3 Claims, 3 Drawing Figures

APPARATUS FOR SILK SCREEN PRINTING

BACKGROUND OF INVENTION

This invention relates to an apparatus and method for screen printing of T-shirts and the like utilizing a vacuum.

Screen printing of T-shirts and the like is typically carried out in the following manner. A printing screen is constructed by covering a frame with a screen of very fine mesh, usually constructed of silk, nylon or similar filament. The holes in the screen are selectively filled by well-known procedures so as to leave unfilled holes in the pattern of design to be printed. The T-shirt to be printed in placed on a table or shirt board and the screen placed on top of the shirt. Suitable ink is then spread across the screen by use of a roller or squeegee which spreads the ink and also presses it through the holes in the screen. This leaves the desired ink pattern on the shirt.

The prior art techniques for screen printing of T-shirts and the like are time consuming and difficult, where manual, and extremely costly where mechanisms are used. For example, screen printing utilizing a vacuum has been applied in the past to paper. Thus, U.S. Pat. No. 3,221,649 describes an apparatus wherein a vacuum is used in conjunction with printing ink. U.S. Pat. No. 3,536,005 uses a very narrow slot vacuum in conjunction with printing on paper. U.S. Pat. No. 3,137,230 uses rollers in cooperation with a vacuum, while U.S. Pat. No. 3,129,442 describes a mechanism for having a vacuum hold thick fabrics in position for penetration by low viscosity color. These screen printing devices which incorporate a vacuum are not applicable to the problems of printing on T-shirts and are extremely complex and costly.

One object of the present invention is to provide an inexpensive reliable apparatus and method for screen printing of T-shirts which incorporates a vacuum and does not use a roller or squeegee.

Other objects and advantages of this invention will be apparent from the description and claims which follow taken together with the appended drawings.

SPECIFIC EXAMPLE OF INVENTION

Figure 2:
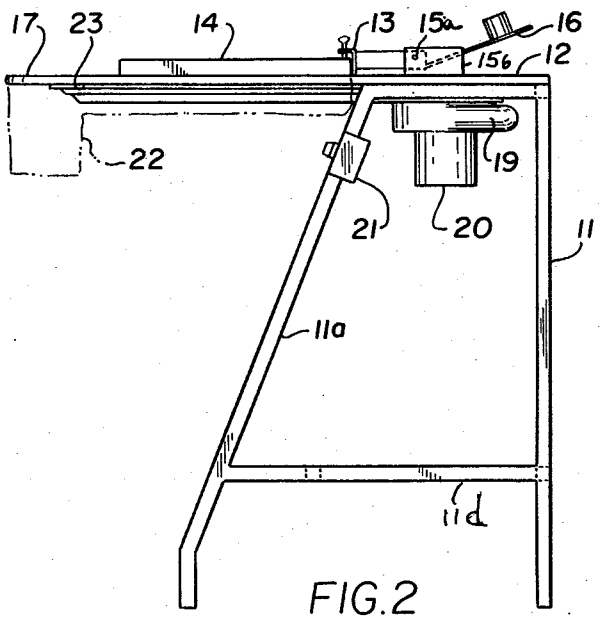
FIG. 2 is a left side view.
Figure 1:
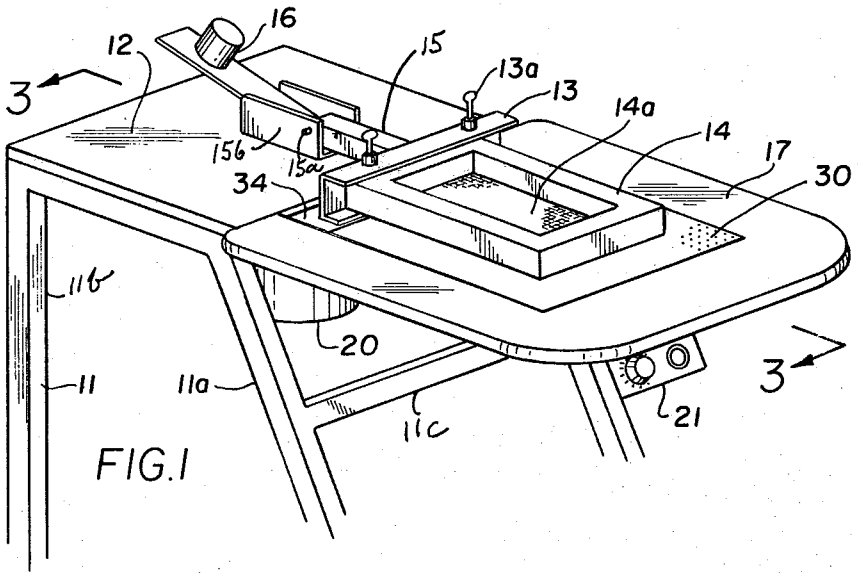
FIG. 1 is a perspective view of one embodiment of the invention.
Figure 3:
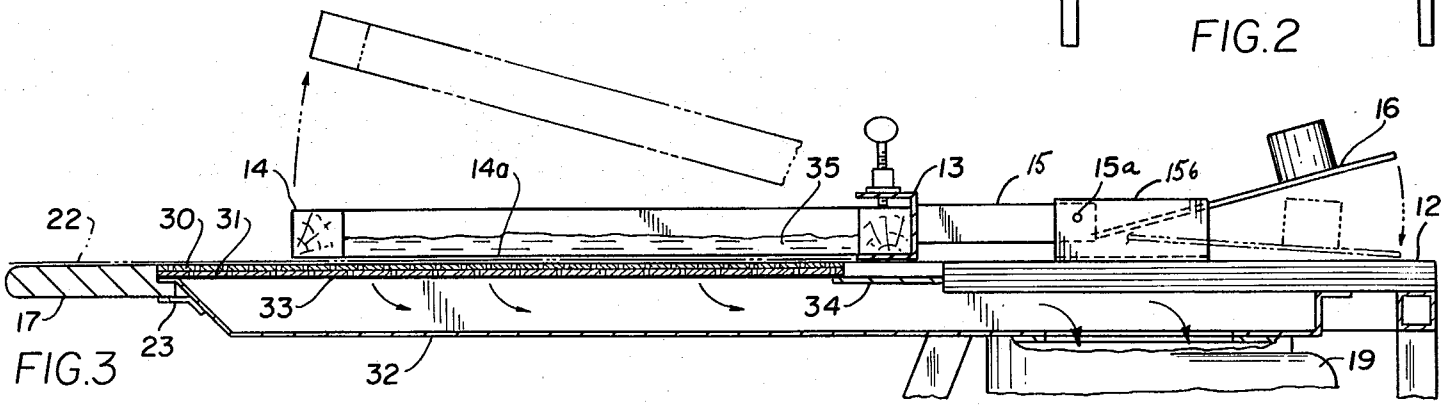
FIG. 3 is a view along line 3—3 of FIG. 1.

Referring now to the drawings, the support for the device comprises a frame 11 having two rear legs 11*b*, a flat top 12, two angular forward legs 11*a*, an upper cross member 11*c* and lower cross frame 11*d*. Extending forward from the support 11 is a duct 32 formed by sheet metal attached to the bottom of the table top 12 and to its front. The duct is covered forwardly by an upper perforated metal sheet 30 and a lower perforated metal sheet 31 which with sealing gasket 33 and cross piece 34 completes the enclosure of the duct 32. The duct supports a track 23 on which an interchangeable shirt board 17 is slidable. The shirt board is preferably aligned with the base of clamp 13. The duct 32 leads to the entrance of an impeller 19 driven by a motor 20 so that the duct acts as a vacuum chamber pulling through the perforated plates 30 and 31 into the impeller 19 and then out to the atmosphere. The perforations of upper metal sheet 30 are smaller and more closely spaced than the lower sheet 31. The operation of the motor-driven impeller is controlled by a timer 21 and a switch.

The screen printing frame 14 which holds the selected printing screen 14*a* is positioned on the perforated plates 30 and 31 by a clamp 13 with clamping members 13*a*. The frame 14 and clamp 13 are supported by elongated member 15. Member 15 is supported by pivot 15*a* mounted on bracket 15*b* on table top 12. Support member 15 extends beyond the pivot to a counterweight 16.

In operation, a suitable highly-viscous ink 35 is placed in the frame 14 on top of the printing screen 14*a*. Because of its high viscosity and the small openings in the printing screen the ink 35 will not penetrate the screen openings in the printing screen 14*a* by gravity alone. After the ink has been loaded it can be tilted upward by applying slight pressure to the counterweight and thus permit rapid insertion of the T-shirt 22 onto the selected board 17 which is held in position. As soon as the shirt is in position the counterweight is released so that the printing frame 14 with the screen 14*a* and ink 35 now rests on the T-shirt 22 which is in position on perforated metal sheet 30. The suction generated by the impeller 19 pulls the ink 35 through the printing screen 14*a* onto the T-shirt 22. After the desired amount of time the vacuum stops, the frame is lifted and the shirt removed from the shirt board 17. The entire operation is rapid and can be readily done with a minimum of skill.

The timer 21 is set for the desired length of time that the suction is to be on. The initiation of operation is caused by the closing of a switch (not illustrated) which can be a foot switch or push-button or a micro switch, magnetic reed switch or similar device attached to the clamp arm 13 so as to be actuated when the screen frame 14 is pulled down in place on the shirt. It is preferable that there be a slight delay time between the time when the switch is actuated to the time when the vacuum motor 20 is actuated. Thus, another timer can be inserted between the switch and the motor 20 to provide an adjustable delay. Once both timers have been set they do not have to be reset as different shirts are inserted for printing.

After one shirt is removed it is then placed in a dryer and another shirt inserted onto the shirt board. The screen openings in the printing screen can be in the range of 10 to 20× and thus provide a finer screen with better resolution. The density is easily controlled by regulating the vacuum time. No squeegee or roller is required. It is merely sufficient to lay the ink into the frame. The only moving part is the vacuum motor. Not only is the device and method of this invention simple and reliable with respect to T-shirts, but it is of particular use to control screen printing of highly absorbent cloth such as terry cloth.

The interchangable shirt board 17 can be changed for shirt boards for different sizes of shirts. In addition, decals or other non-porous material can be printed with the apparatus of this invention by removing the shirt board and laying the material directly on the perforated plates 30 and 31 and printing by the conventional squeegee method. If license plates, key chains or other irregular shaped items are to be printed a flat plate can be substituted for the perforated plate thus providing a versatility for this apparatus not found in prior art devices.

I claim:

1. A screen printing device for T-shirts and the like comprising:

(a) support means including a table top;

(b) duct means extending forward from said table top and having an upper opening;

(c) flat perforated sheet means covering said duct opening;

(d) vacuum means attached to said duct means;

(e) track means on the sides of said sheet means;

(f) a U-shaped shirt board slidable on said track means so as to surround three sides of the sheet means;

(g) a screen frame adapted to contain a printing screen;

(h) means to hold said screen frame in position so as to permit a printing screen to contact a T-shirt on said flat perforated sheet means; and (i) means for controlling the time of operation of said vacuum means;

said device being so characterized that printing is done without a squeegee by timed operation of said vacuum means where an ink is used which cannot penetrate the screen openings by gravity alone.

2. The screen printing device of claim 1 wherein the means for holding the screen frame in position is pivotally mounted on said support means and includes an arm which holds said screen frame at one end and a counterweight on the other end.

3. The screen printing device of claim 1 wherein said shirt board is interchangeable.

* * * * *